US009199446B2

(12) United States Patent
Nadrchal et al.

(10) Patent No.: US 9,199,446 B2
(45) Date of Patent: Dec. 1, 2015

(54) COATING APPARATUS AND METHOD

(75) Inventors: Thomas Lee Nadrchal, Mokena, IL (US); John Matthias Nader, Valparaiso, IN (US); Thomas James Payer, Valparaiso, IN (US); Robert Steven Orto, Valparaiso, IN (US); Michael Wayne Back, Crown Point, IN (US)

(73) Assignee: Global Web Finishing, LLC, Merrillville, IN (US)

( * ) Notice: Subject to any disclaimer, the term of this patent is extended or adjusted under 35 U.S.C. 154(b) by 889 days.

(21) Appl. No.: 13/167,862

(22) Filed: Jun. 24, 2011

(65) Prior Publication Data

US 2011/0318492 A1 Dec. 29, 2011

Related U.S. Application Data

(60) Provisional application No. 61/358,587, filed on Jun. 25, 2010.

(51) Int. Cl.

| | |
|---|---|
| ***B05C 1/08*** | (2006.01) |
| ***B05D 1/36*** | (2006.01) |
| ***B41F 23/08*** | (2006.01) |
| ***B41F 13/44*** | (2006.01) |

(52) U.S. Cl.

CPC ..... *B41F 23/08* (2013.01); *B41F 13/44* (2013.01)

(58) Field of Classification Search

None

See application file for complete search history.

(56) References Cited

U.S. PATENT DOCUMENTS

| | | | | |
|---|---|---|---|---|
| 1,329,325 | A * | 1/1920 | Mascord | 101/216 |
| 4,309,945 | A * | 1/1982 | Marion | 101/247 |
| 4,474,110 | A * | 10/1984 | Rosner | 101/170 |
| 4,864,927 | A * | 9/1989 | Niehaus | 101/181 |
| 5,370,047 | A * | 12/1994 | Compton | 101/216 |
| 6,006,665 | A * | 12/1999 | Stuchlik et al. | 101/352.13 |
| 6,312,367 | B1 * | 11/2001 | Rogge | 492/35 |
| 6,332,397 | B1 * | 12/2001 | Bolza-Schunemann et al. | 101/183 |
| 2004/0050275 | A1 * | 3/2004 | Masuch | 101/349.1 |
| 2006/0107852 | A1 * | 5/2006 | Motard | 101/142 |

* cited by examiner

*Primary Examiner* — Charles Capozzi

(74) *Attorney, Agent, or Firm* — Hartman Global IP Law; Gary M. Hartman; Domenica N. S. Hartman

(57) ABSTRACT

A rotary-style coating machine of the type capable of applying coatings to various web substrates in the commercial offset web and/or digital web printing industry. The coating machine includes a coating cylinder and a plate cylinder that are rotatably mounted within the machine. The coating cylinder includes a coating sleeve removably mounted on a mandrel, and the plate cylinder includes a plate sleeve removably mounted on another mandrel. The machine further includes a unit for depositing a coating material on the coating sleeve as the coating cylinder is rotated. The plate cylinder is operative to receive the coating material from the coating sleeve. An impression cylinder supports a web substrate that receives the coating material from the plate sleeve.

14 Claims, 3 Drawing Sheets

COATING APPARATUS AND METHOD

CROSS REFERENCE TO RELATED APPLICATIONS

This application claims the benefit of U.S. Provisional Application No. 61/358,587, filed Jun. 25, 2010, the contents of which are incorporated herein by reference.

BACKGROUND OF THE INVENTION

The present invention generally relates to equipment and processes used in the commercial printing industry. More particularly, this invention relates to a web coating apparatus and method suitable for use in inline and offline web-fed finishing systems used in the commercial web printing industry.

Various types of coating (printing) machines are known and used in the commercial offset web industry. A particular type of coating machine is adapted to transfer a liquid coating to a pre-printed substrate, referred to as a web, formed of a suitable material, for example, paper. The coating process often uses a rotary-style coating machine that includes a coating cylinder (for example, an anilox roller) having a cylindrical outer surface to which a coating is applied as the coating cylinder rotates. A doctor blade assembly is typically used with an anilox roller to remove excess coating from the surface of the coating cylinder, to ensure that the coating cylinder carries a relatively uniform layer of coating on its cylindrical surface. The coating may be applied to the coating cylinder through contact with a second cylinder that is partially submerged in the coating within a reservoir, or directly applied by partially submerging the coating cylinder in the coating. Another alternative is to apply the coating using an enclosed coating chamber that incorporates the doctor blade assembly. The coating cylinder transfers the coating to a rotating fixed repeat-sized plate cylinder (roller), which in turn carries the coating to the web. The plate cylinder carries a raised pattern such that the coating transferred to the plate cylinder will form the desired coating on the web, for example, a gloss or mat finish. The transfer of coating from the plate cylinder to the web occurs at a printing nip between the plate cylinder and a rotating impression cylinder (roller). Once the printed web has traveled away from the printing nip, the coating on the web is cured, for example, using an ultraviolet (UV) curing lamp system. One or more optional "chill rolls" may be placed at the exit of the curing system to help remove excess temperature from the web and control the tension in the web downstream of the curing process.

Rotary-style coating machines of the type described above have been historically limited to applying a very narrow range of coatings, such as "gloss coatings," to substrates. The narrow range of coatings is inherently due to the coating cylinder having a fixed anilox construction. While certain coating machines are described as having a removable and/or changeable coating cylinder, the process requires the removal of the complete coating cylinder from the machine, resulting in an extensive process of uncoupling the drive train and unbolting and lifting heavy cylinders. This process is typically very costly, time consuming and potentially unsafe, with the result that many in the printing industry do not remove and replace coating cylinders.

Rotary-style coating machines are also typically dedicated to a plate cylinder having a certain circumference size (referred to as fixed press repeat), with all cylinders of the machine, with the exception of any optional chill rolls, driven together by a single motor or mechanical drive train. A drawback of all cylinders being driven together is the inability to change the repeat (circumference size) of the plate cylinder without making gearing changes. The result is that typical coating machines are dedicated to a fixed size printing press application matching a single image repeat.

BRIEF DESCRIPTION OF THE INVENTION

The present invention provides a rotary-style coating machine (apparatus) of the type capable of applying coatings to various woven or nonwoven web substrates in the commercial offset web, digital, flexographic, or rotogravure web-fed printing industries.

According to a first aspect of the invention, the coating machine includes a coating cylinder and a plate cylinder that are rotatably mounted within the machine, and individual means for rotating the coating cylinder and plate cylinder about their respective axes. The coating cylinder comprises a coating cylinder mandrel and at least a first coating sleeve removably mounted on the coating cylinder mandrel. The machine further includes means for depositing a coating material on the first coating sleeve as the coating cylinder is rotated. The plate cylinder comprises a plate cylinder mandrel and a plate sleeve removably mounted on the plate cylinder mandrel, and the plate cylinder is operatively positioned within the machine to receive the coating material from the first coating sleeve. An impression cylinder is operatively positioned within the machine to support a web substrate as it receives the coating material from the plate sleeve. Means is also provided for moving the plate cylinder and the impression cylinder relative to the coating cylinder in directions transverse to the axis of the coating cylinder.

According to a second aspect of the invention, a method is provided for operating the coating machine to print different coatings on multiple web substrates. The method entails depositing the coating material on the first coating sleeve as the coating cylinder is rotated by the rotating means associated therewith, transferring the coating material on the first coating sleeve to the plate sleeve of the plate cylinder as the plate cylinder is rotated by the rotating means associated therewith, transferring the coating material on the plate sleeve to the web substrate to form a first coating on the web substrate, moving the plate cylinder and the impression cylinder relative to the coating cylinder in directions transverse to and away from the coating cylinder, removing the first coating sleeve from the coating cylinder mandrel and installing a second coating sleeve on the coating cylinder mandrel, depositing a second coating material on the second coating sleeve as the coating cylinder is rotated by the rotating means by the rotating means associated therewith, transferring the second coating material on the second coating sleeve to the plate sleeve of the plate cylinder as the plate cylinder is rotated by the rotating means associated therewith, and transferring the second coating material on the plate sleeve to a second web substrate to form a second coating on the second substrate.

In view of the above, it can be seen that a significant advantage of this invention is that the coating machine provides a "quick change" capability with respect to the coating and plate cylinders, allowing for the use of coating sleeves having different coating material transfer characteristics and the use of plate sleeves having different thicknesses, which in combination can achieve a vast range of value-added coating possibilities at essentially any repeat (plate cylinder circumference).

Other aspects and advantages of this invention will be better appreciated from the following detailed description.

DETAILED DESCRIPTION OF THE INVENTION

Figure 1:
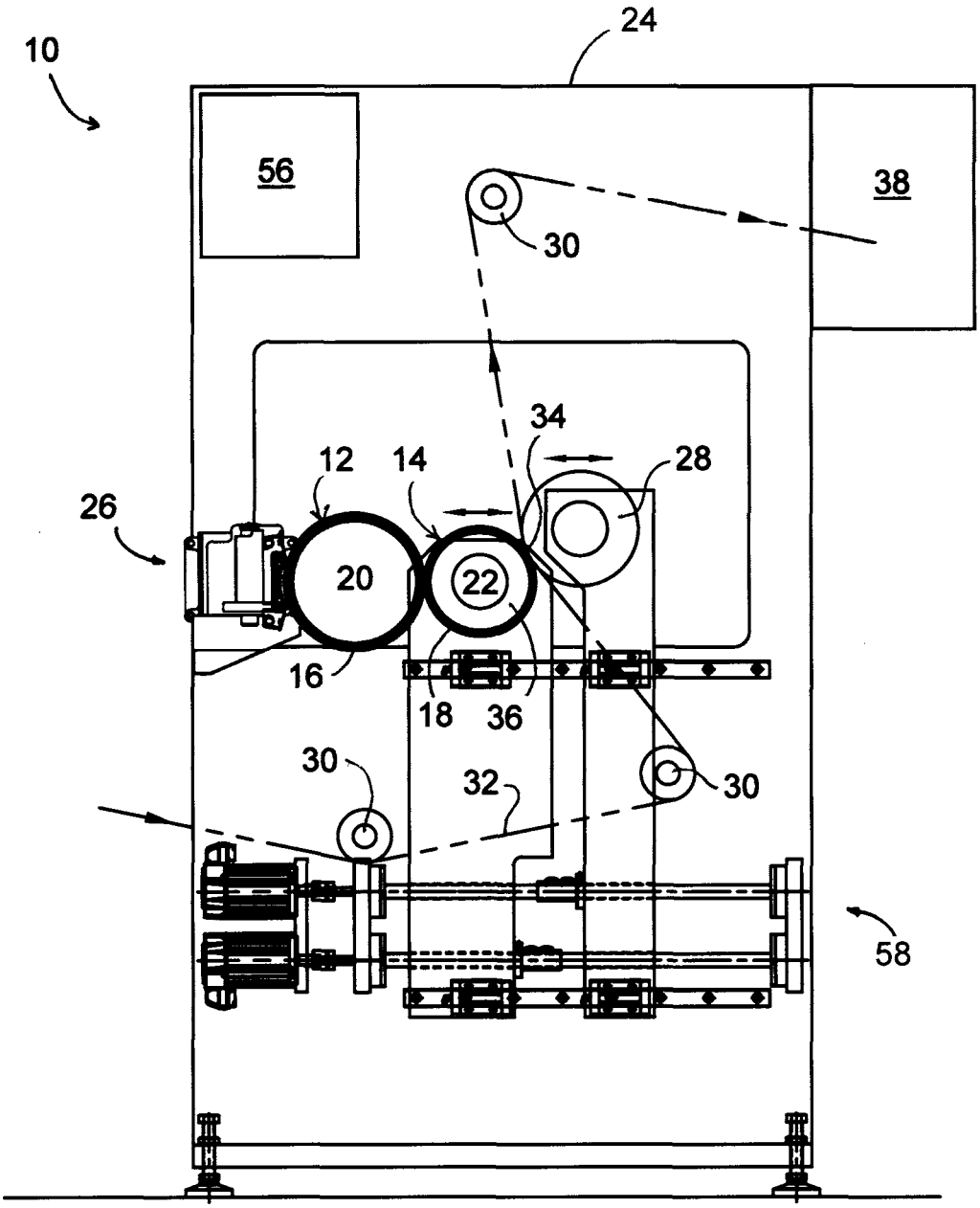
FIGS. 1 and 2 represent a rotary-style coating machine in accordance with an embodiment of this invention, and shows the ability of the coating machine to accommodate plate cylinders of different circumference size (repeat).
Figure 2:
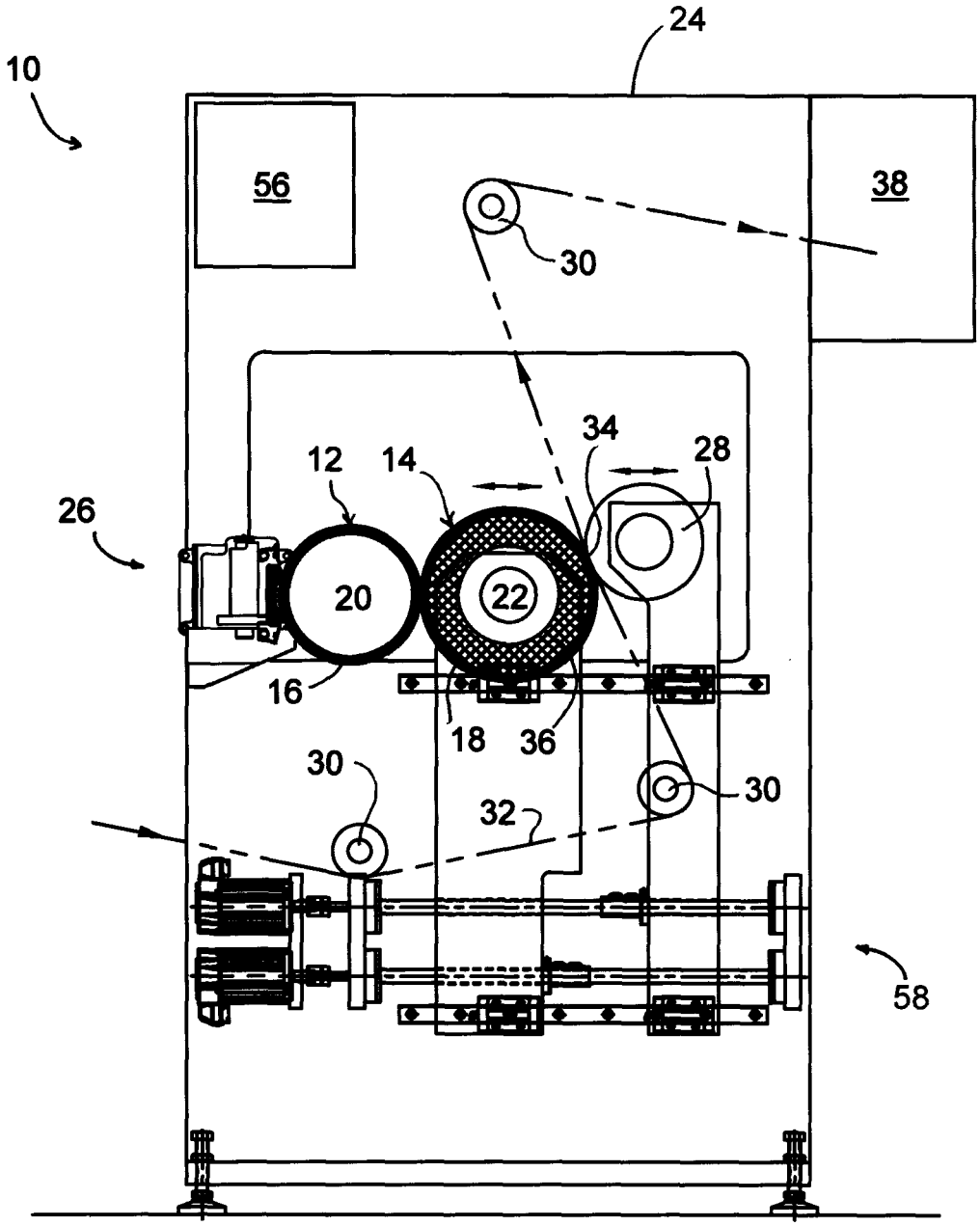

FIGS. 1 and 2 represent a rotary-style coating machine 10 of a type suitable for illustrating preferred aspects of the invention. The coating machine 10 is adapted to provide the operator of the machine 10 with a "quick change" capability through the inclusion of a coating cylinder 12 and plate cylinder 14 that are each configured to have changeable sleeves 16 and 18, respectively, that can be mounted to what will be referred to as a coating mandrel 20 and a plate mandrel 22, respectively. As will be discussed below, the sleeves 16 and 18 of the coating and plate cylinders 12 and 14 can have different radial thicknesses and other characteristics that enable a wide range of coating processes and repeats (plate cylinder circumferences). To schematically illustrate, the plate cylinder 14 of FIG. 2 is represented as having a plate sleeve 18 having a different diameter than the plate sleeve 18 of FIG. 1. Though cylinder sleeve removal and changing has been practiced in the past, such use has been primarily with printing presses in the flexographic printing industry, for example, of the type widely used in the packaging industry, as well as blanket changes on web offset printing presses.

The coating machine 10 is schematically represented as comprising an enclosure or framework 24 that contains the coating and plate cylinders 14 and 16. The framework 24 further comprises an enclosed doctor blade chamber 26 with which coating can be uniformly applied to the coating cylinder 12, an impression cylinder 28, and rollers 30 arranged to transport a web substrate 32 through the framework 24 and a printing nip 34 defined between the plate and impression cylinders 14 and 28. The doctor blade chamber 26, impression cylinder 28 and rollers 30 can be of any suitable type, and therefore will not be discussed here in any details here. As an alternative to the doctor blade chamber 26, it is foreseeable that a pan roll system could be used to apply coatings to the coating cylinder 12.

The coating cylinder 12 is preferably an anilox cylinder, in which case the sleeve 16 of the coating cylinder 12 will be referred to as an anilox sleeve 16. As known in the art, a conventional anilox cylinder typically comprises a hard metal cylindrical core on which a ceramic layer has been formed. The surface of the ceramic layer contains numerous very small laser-engraved cells, whose characteristics determine the amount of coating that can carried by an anilox cylinder and, therefore, can be transferred from the anilox cylinder to a plate cylinder. Details regarding the use of certain materials, cell characteristics, etc., to achieve desired coating transfer and printing capabilities are generally understood in the art, and therefore will not be discussed in any detail here. The mandrel 20 of the coating cylinder 12 can be an air mandrel that enables the coating sleeve 16 to be released with air pressure, as known in the art. In particular, the mandrel 20 can be fabricated as a hollow cylinder with pinholes in its outer cylindrical wall so that air introduced into the interior of the mandrel 20 is able to force a sleeve 16 installed on the mandrel 20 in a radially outward direction from the mandrel 20, allowing the sleeve 16 to be installed and removed from the mandrel 20 with relative ease. A suitable sleeve construction for this purpose includes fabricating the coating sleeve 16 to have a relatively rigid tubular support structure, for example, an aluminum tube, on whose interior surface a compressible membrane is provided and on whose exterior surface the ceramic anilox layer is provided. The compressible membrane is sized to create an interference fit with the mandrel 20, but can be compressed by air flowing through the pinholes of the mandrel 20 to eliminate the interference fit or otherwise permit the sleeve 16 to be installed and removed from the mandrel 20.

Of significant here is the ability to change the anilox sleeve 16 of the coating cylinder 12, which allows for the use of different configurations of anilox cells to achieve different coating transfer characteristics, as well as allow the use of different types of coatings, including but are not limited to gloss varnishes, matte varnishes, silicone release coatings, scratch-off coatings, glitter, pearl effect and glow-in-the-dark coatings, pseudo "emboss" coatings, pseudo "sheet magnet" coatings, thermo chromatic coatings, and magnetic strips for embedded card information. Such coatings may be curable with the use of ultra-violet (UV) radiation, infrared (IR) radiation, heat, and other known means. This wide range of coatings is possible and practical due to the quick-change capability of the anilox sleeve 16, which allows for the selection and installation of a sleeve 16 having a desired anilox cell size and count that can be tailored to achieve certain coating characteristics. With this capability, an operator of the machine 10 has the ability to work directly with a coating supplier to tailor the anilox cell pattern of a particular anilox sleeve 16 to optimize the lay down (print) for a specific coating weight, viscosity, thickness, texture, etc., for a particular type of web substrate 32. This capability also allows for the fabrication of an anilox sleeve 16 that is partitioned to have longitudinal regions located around the circumference of the sleeve 16 that have different cell sizes and/or counts to enable the application of multiple different coatings of different characteristics across the web substrate 32. Such an anilox sleeve 16 would be used in combination with a doctor blade chamber 26 that is partitioned to be capable of depositing different amounts or types of coating on different regions of the anilox sleeve 16.

As noted above, the plate cylinder 14 of the machine 10 is also configured to have a changeable sleeve 18, which enables the operator of the machine 10 to change the repeat (circumference size) of the plate cylinder 14. In addition, the ability to change the anilox sleeve 16 of the coating cylinder 12 to have a variety of different coating transfer characteristics and allow the use of different types of coatings may require, under some circumstances, that plate cylinder sleeves 18 used with the machine 10 to also be adapted to carry a range of different coating volumes to the web substrate 32 to achieve different final coating thicknesses, overprint sequences, screen patterns, intricacies, etc. The sleeve 18 of the plate cylinder 14 can be secured to its mandrel 22 in a manner similar to that described for the coating cylinder 12, namely, by configuring the mandrel 22 as an air mandrel. For this purpose, the construction of the plate sleeve 18 can comprise a tube formed of plastic or another suitable material, and a compressible membrane on the interior surface of the tube for creating an interference fit with the mandrel 22. The exterior surface of the tube can be provided with a photopolymer plate or any other suitable layer or material that, depending on the particular requirements of the coating processes and the web substrate 32, is capable of suitably transferring the coating material from the coating cylinder 12 to the web substrate 32.

Existing technology for plate cylinder sleeves can be used to produce sleeves 18 for use with the invention that are capable of high quality photo-polymer construction, including endless photo-polymer sleeves that can be installed on a reusable support sleeve 36, which is in turn installed on the plate cylinder mandrel 22. The operator of the machine 10 can have the option of using an electronic file of the image to be printed to produce the plate cylinder sleeve 18 directly on the reusable support sleeve 36, which can reduce the "make-ready" for the machine, reduce the risk of operator error of image registration, and increase quality coating performance due to the elimination of seams ordinarily present in plate cylinders of the prior art.

In view of the ability to vary the repeat (circumference) size (and, therefore, the diameter) of the plate cylinder 14 through the selection and installation of different plate sleeves 18, the coating, plate and impression cylinders 12, 14 and 28 are all preferably individually driven, for example, with separate motors (not shown). As a result of the plate cylinder 14 being driven by a separate motor, plate sleeves 18 of various thicknesses can be used in a range of repeat (circumference) sizes to match virtually any print repeat length. This aspect of the invention allows the operator of the machine 10 to coat any preprinted web substrate 32 of any repeat length simply by changing the plate sleeve 18 to match the desired circumference. Particularly suitable mechanisms for independently driving the coating, plate and impression cylinders 12, 14 and 28 include servo or vector-type motors (represented as a motor 46 in FIGS. 3 and 4), though it is foreseeable that other mechanisms could be used for this purpose.

Independent drives for each of the coating and plate cylinders 12 and 14 allow the diameter/circumference of the plate cylinder 14 to change for immediate adaptation to a wide range of repeat print lengths/presses by enabling the matching of repeat and surface speed. This aspect of the invention also allows the operator to print to either surface (the "top side" or "bottom side") of the web substrate 32 by simply reversing the drive rotational directions of the cylinders 12, 14 and 28. This aspect of the invention also allows two of the machines 10 to be combined in tandem for "perfecting" applications, in other words, to coat in sequence both surfaces (sides) of the web substrate 32.

To accommodate different cylinder circumferences, the plate cylinder 14 and impression cylinder 28 must also be able to move relatively to each other and to the coating cylinder 12 in directions transverse to their axes. As a nonlimiting example, horizontal movements of the cylinders 14 and 28 are represented by two horizontal arrows in FIGS. 1 and 2, to adjust for different repeat sizes of the plate cylinder 14. This movement of the plate and impression cylinders 14 and 28 also allows the cylinders 14 and 28 to be moved relative to the coating cylinder 12 so that the coating sleeve 16 and plate sleeve 18 can be changed. Particularly suitable mechanisms for enabling the relative movement of the coating, plate and impression cylinders 12, 14 and 28 include precision profile linear bearing rail systems 58 associated with the plate and impression cylinders 14 and 28, though it is foreseeable that other mechanisms could be used for this purpose.

In combination, the independently-driven coating, plate and impression cylinders 12, 14 and 28 and the ability to move the plate and impression cylinders 14 and 28 relative to each other and relative to the coating cylinder 12 enables very precise cylinder-to-cylinder impression settings, which further enable registered deposition of coatings capable of achieving intricate print patterns and registration features. Such precise movements of the cylinders 14 and 28 provide much greater accuracy and stability than current eccentric side frame impression designs commonly used in the art.

Figure 3:
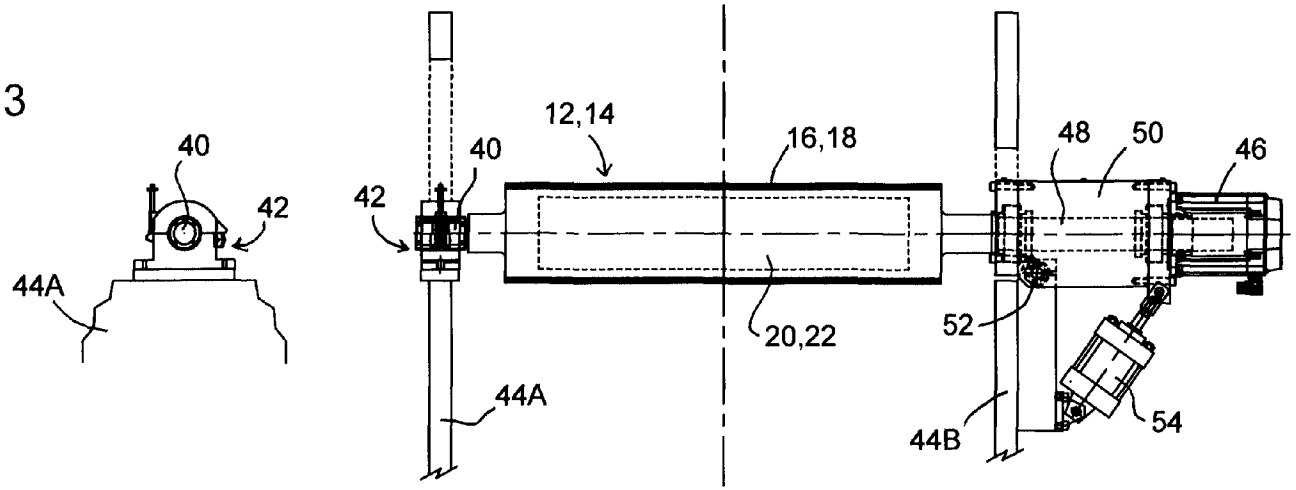
FIG. 3 represents the coating or plate cylinder of the coating machine of FIGS. 1 and 2 in a typical run position during operation of the coating machine.
Figure 4:
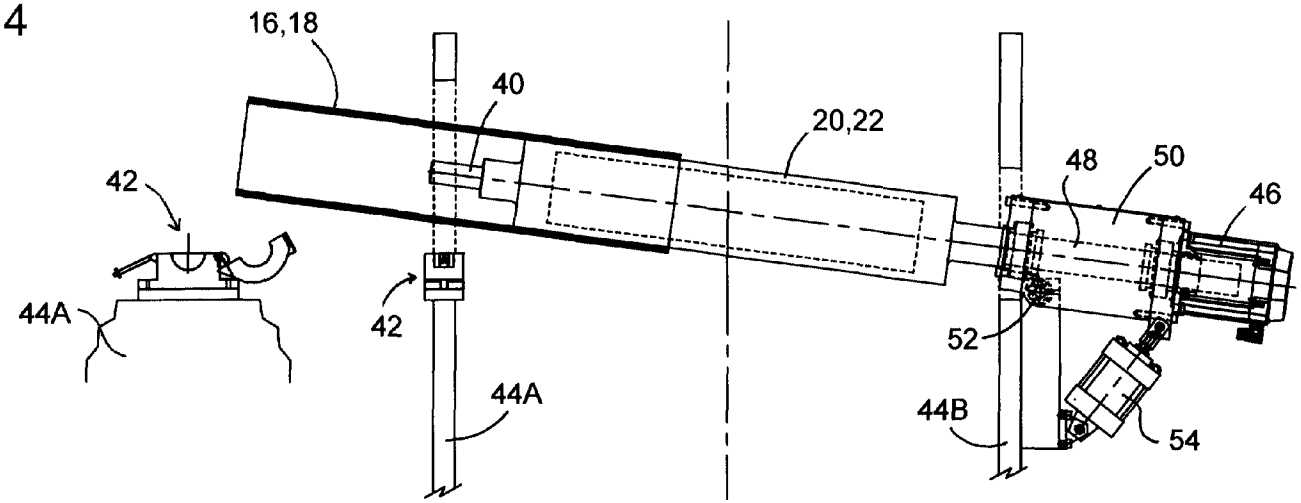
FIG. 4 represents a manner in which the circumference size of the coating and/or plate cylinders of FIG. 3 can be changed in accordance with an embodiment of this invention.

FIGS. 3 and 4 schematically represent views of the coating or plate cylinder 12 or 14, and the manner in which the cylinder 12/14 can be manipulated to enable sleeves 16/18 to be removed and installed. FIG. 3 shows a side view (perpendicular to the axis of the cylinder 12/14) and an end view of the cylinder 12/14, representing an axle 40 at one end of the cylinder 12/14 as rotatably secured with a bearing unit 42 to a section 44A of the framework 24 of the machine 10. An independent drive motor 46 (i.e., the drive motors 46 of the cylinders 12 and 14 are independently operable at different speeds) is coupled to an axle 48 at the opposite end of the cylinder 12/14, and mounted to another section 44B of the framework 24 with a housing 50 that includes a pivot joint 52. The bearing unit 42 is adapted to allow the axle 40 of the cylinder 12/14 to be released, after which a pneumatic (or hydraulic) cylinder 54 coupled to the housing 50 can be operated to pivot the axle 40 of the cylinder 12/14 out of engagement with the bearing unit 42, as represented in FIG. 4. The existing sleeve 16 and 18 can then be removed and replaced with a second sleeve 16/18.

Downstream of the impression cylinder 28, the machine 10 can optionally comprise a curing unit 38, for example, a UV, infrared (IR), heater, or other type of curing device suitable for curing the particular coating being applied by the machine 10. Further downstream from the curing unit 38, the machine 10 may include one or more chill rolls (not shown) to remove excess heat from the web substrate 32 and control the tension in the web substrate 32 downstream of the curing process. The incorporation of the curing unit 38 and chill rolls within the machine 10 can be advantageous in view of the pattern repeat intricacy of the machine 10 resulting from its changeable coating and plate sleeves 16 and 18 and the positioning capability of the plate and impression cylinders 14 and 28 relative to the coating cylinder 12. In particular, the ability to stabilize the tension in the web substrate 32 facilitates higher quality registration by enhancing the circumferential register control aspect of the machine 10.

In view of the above, the operator of the machine 10 has the ability to select a repeat size by selecting and installing an appropriate plate sleeve 18. According to a preferred aspect of the invention, the selection of the plate sleeve 18 can be used as inputs to an automated control system 56 capable of automatically positioning the plate and impression cylinders 14 and 28 to their proper positions relative to the coating cylinder 12 based on the selected repeat size. In this manner, the control system 56 can automatically adjust the speed of the individual drive motor 46 of the plate cylinder 14 for the intended repeat (circumference) change, while the rotational speeds of the drive motor 46 for the coating cylinder 12 (and, presumably, the drive motor (not shown) of the impression cylinder 28) can be adjusted or maintained to achieve surface speeds that match the existing or desired speed of the web substrate 32.

While the invention has been described in terms of a specific embodiment, it is apparent that other forms could be adopted by one skilled in the art. For example, the machine 10 could differ in appearance and construction from what is schematically represented in the Figures, and the functions of various components of the machine 10 could be performed by components of different construction but capable of a similar (though not necessarily equivalent) function. Therefore, the scope of the invention is to be limited only by the following claims.

The invention claimed is:

1. A coating machine comprising:

a coating cylinder rotatably mounted within the machine for rotation about an axis of the coating cylinder, the coating cylinder comprising a coating cylinder mandrel and a first coating sleeve removably mounted on the coating cylinder mandrel for rotation with the coating cylinder mandrel about the axis of the coating cylinder;

a first drive motor for rotating the coating cylinder about the axis thereof;

means for depositing a coating material on the first coating sleeve as the coating cylinder is rotated by the first drive motor;

a plate cylinder rotatably mounted within the machine for rotation about an axis of the plate cylinder, the plate cylinder being operatively positioned within the machine to receive the coating material from the first coating sleeve, the plate cylinder comprising a plate cylinder mandrel and a first plate sleeve removably mounted on the plate cylinder mandrel for rotation with the plate cylinder mandrel about the axis of the plate cylinder;

a second drive motor for rotating the plate cylinder about the axis thereof as the plate cylinder receives the coating material from the first coating sleeve;

first and second means for manipulating, respectively, the coating cylinder and the plate cylinder to enable, respectively, removal of the first coating sleeve from the coating cylinder mandrel in an axial direction of the coating cylinder and removal of the first plate sleeve from the plate cylinder mandrel in an axial direction of the plate cylinder, the first means for manipulating the coating cylinder comprising first securing means for rotatably and releasably securing a first axle of the coating cylinder and means for pivoting the coating cylinder and the first drive motor associated therewith to cause the first axle to move into and out of engagement with the first securing means, the second means for manipulating the plate cylinder comprising second securing means for rotatably and releasably securing a second axle of the plate cylinder and means for pivoting the plate cylinder and the second drive motor associated therewith to cause the second axle to move into and out of engagement with the second securing means;

an impression cylinder operatively positioned within the machine to support a web substrate that receives the coating material from the first plate sleeve; and means for moving the plate cylinder and the impression cylinder relative to the coating cylinder in directions transverse to the axis of the coating cylinder.

2. The coating machine according to claim 1, wherein the first plate sleeve is one of a plurality of plate sleeves that comprise a second plate sleeve adapted to be removably mounted on the plate cylinder mandrel, and the first and second plate sleeves have different radial thicknesses that alter the diameter of the plate cylinder.

3. The coating machine according to claim 1, wherein the first coating sleeve is one of a plurality of coating sleeves that comprise a second coating sleeve adapted to be removably mounted on the coating cylinder mandrel.

4. The coating machine according to claim 3, wherein the first and second coating sleeves are first and second anilox sleeves comprising anilox cells.

5. The coating machine according to claim 4, wherein the anilox cells of the first and second anilox sleeves are configured to have different coating material transfer characteristics.

6. The coating machine according to claim 5, wherein the anilox cells of the first and second anilox sleeves have different cell sizes and different cell counts.

7. The coating machine according to claim 3, wherein the first coating sleeve is partitioned to have longitudinal regions located around a circumference thereof, and the longitudinal regions contain anilox cells that are different from each other in terms of at least one of anilox cell size and anilox cell count.

8. The coating machine according to claim 3, wherein the first and second coating sleeves are adapted to transfer coating materials to produce coatings on the web substrate that differ in at least one aspect chosen from the group consisting of coating weight, viscosity, thickness and texture.

9. The coating machine according to claim 3, wherein the first and second coating sleeves are adapted to transfer coating materials chosen from the group consisting of gloss varnishes, matte varnishes, silicone release coatings, scratch-off coatings, glitter, glow-in-the-dark coatings, emboss coatings, sheet magnet coatings, thermo chromatic coatings, and magnetic strips for embedded card information.

10. The coating machine according to claim 1, wherein the first and second drive motors associated with the coating and plate cylinders are independently operable at different rotational speeds relative to each other.

11. The coating machine according to claim 10, further comprising a control system for controlling the rotational speeds of the first and second drive motors associated with the coating and plate cylinders.

12. The coating machine according to claim 11, wherein the control system controls the rotational speeds of the first and second drive motors associated with the coating and plate cylinders based on inputs comprising size of the coating and plate cylinders.

13. The coating machine according to claim 1, wherein the first axle is at an end of the coating cylinder opposite the first drive motor associated with the coating cylinder.

14. The coating machine according to claim 1, wherein the second axle is at an end of the plate cylinder opposite the second drive motor associated with the plate cylinder.

* * * * *